US006683426B1

(12) United States Patent
Kleeven

(10) Patent No.: US 6,683,426 B1
(45) Date of Patent: Jan. 27, 2004

(54) ISOCHRONOUS CYCLOTRON AND METHOD OF EXTRACTION OF CHARGED PARTICLES FROM SUCH CYCLOTRON

(75) Inventor: William Kleeven, Kessel-Lo (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 0 days.

(21) Appl. No.: 10/031,027

(22) PCT Filed: Mar. 31, 2000

(86) PCT No.: PCT/BE00/00028

§ 371 (c)(1),
(2), (4) Date: Jan. 14, 2002

(87) PCT Pub. No.: WO01/05199

PCT Pub. Date: Jan. 18, 2001

(30) Foreign Application Priority Data

Jul. 13, 1999 (EP) ..... 99870156

(51) Int. Cl.[7] ..... H05H 13/00; H01J 25/00; H05J 7/00

(52) U.S. Cl. ..... 315/502; 315/500; 315/501

(58) Field of Search ..... 313/62, 502; 376/112; 315/500, 501, 502; 250/291, 298

(56) References Cited

U.S. PATENT DOCUMENTS

| | | | | | |
|---|---|---|---|---|---|
| 2,812,463 | A | | 11/1957 | Teng et al. | |
| 3,024,379 | A | | 3/1962 | Verster | |
| 3,582,700 | A | * | 6/1971 | Hendry | 313/62 |
| 3,925,676 | A | * | 12/1975 | Bigham et al. | 376/112 |
| 4,771,208 | A | * | 9/1988 | Jongen et al. | 313/62 |
| 4,943,781 | A | * | 7/1990 | Wilson et al. | 315/502 |
| 5,017,882 | A | * | 5/1991 | Finlan | 315/502 |
| 5,521,469 | A | * | 5/1996 | Laisne | 315/502 |
| 6,057,655 | A | * | 5/2000 | Jongen | 315/502 |

FOREIGN PATENT DOCUMENTS

| | | |
|---|---|---|
| DE | 1815748 | 7/1970 |
| EP | 0 222 786 | 7/1990 |
| EP | 0 853 867 | 7/1999 |
| FR | 2 320 680 | 3/1977 |
| FR | 2 544 580 | 10/1984 |
| WO | WO93/10651 | 5/1993 |
| WO | WO97/14279 | 4/1997 |

OTHER PUBLICATIONS

Zeller et al., "An adjustable permanent magnet focussing system for heavy ion beams," *IEEE Transactions on Magnetics*, 24:2,. pp. 990–993 (Mar. 1988).

Duval et al., "New compact cyclotron design for SPIRAL," *IEEE Transactions on Magnetics*, 32:4, pp. 2194–2196 (Jul. 1996).

Richardson et al., "Note on a spill beam from the 88–inch cyclotron," *Nuclear Instruments and Methods*, 18:19, pp. 41–45 (1962).

Kelly et al., "Two electron models of a constant–frequency relativistic cyclotron," *The Review of Scientific Instruments*, 27:7, pp. 493–503 (Jul. 1956).

* cited by examiner

*Primary Examiner*—John R. Lee
*Assistant Examiner*—Mary El-Shammaa
(74) *Attorney, Agent, or Firm*—Merchant & Gould P.C.

(57) ABSTRACT

The present inventions is related to a superconducting or non-superconducting isochronous sector-focused cyclotron, comprising an electromagnet with an upper pole and a lower pole that constitute the magnetic circuit, the poles being made of at least three pair of sectors (3,4) called "hills" where the vertical gap between said sectors is small, these hill-sectors being separated by sector-formed spaces called "valleys" (5) where the vertical gap is large, said cyclotron being energized by at least one pair of main coils (6), characterised in that at least one pair of upper and lower hills is significantly longer than the remaining pair of hill sectors in order to have at least one pair of extended hill sectors (3) and at least one pair of non-extended hill sectors (4) in that a groove (7) or a "plateau" (7') which follows the shape of the extracted orbit is present in said pair of extended hill sectors (3) in order to produce a dip (200) in the magnetic field.

13 Claims, 11 Drawing Sheets

ISOCHRONOUS CYCLOTRON AND METHOD OF EXTRACTION OF CHARGED PARTICLES FROM SUCH CYCLOTRON

FIELD OF THE INVENTION

The present invention is related to an isochronous cyclotron that can be a compact isochronous cyclotron as well as a separate sector cyclotron.

The present invention applies both to super-conducting and non-super-conducting cyclotrons.

The present invention is also related to a new method to extract charged particles from an isochronous sector-focused cyclotron.

STATE OF THE ART

A cyclotron is a circular particle accelerator which is used to accelerate positive or negative ions up to energies of a few MeV or more. Cyclotrons can be used for medical applications (production of radioisotopes or for proton therapy) but also for industrial applications, as injector into another accelerator, or for fundamental research.

A cyclotron consists of several sub-systems of which the most important are mainly the magnetic circuit; the RF acceleration system, the vacuum system, the injection system and the extraction system.

The most important is the magnetic circuit by which a magnetic field is created. This magnetic field guides the accelerated particles from the centre of the machine towards the outer radius of the machine in such a way that the orbits of the particles describe a spiral. In the earliest cyclotrons the magnetic field was created in a vertical gap between two cylindrically shaped poles by two solenoid coils wound around these poles. In more recent isochronous cyclotrons these poles no longer consist of one solid cylinder, but are divided into sectors such that the circulating beam alternately experiences a high magnetic field created in a hill sector where the gap between the poles is small, followed by a lower magnetic field in a valley sector where the gap between the poles is large. This azimuthal magnetic field variation, when properly designed, provides radial as well as vertical focusing and at the same time allows the particle revolution frequency to be constant throughout the machine.

Two types of isochronous cyclotrons exist: the first type is the compact cyclotron where the magnetic field is created by one set of circular coils wound around the total pole; the second type is the separate sector cyclotron where each sector is provided with its own set of coils.

Document EP-A-0222786 describes a compact sector-focused isochronous cyclotron, called "deep-valley cyclotron", which has a very low electrical power consumption in the coils. This is achieved by a specific magnetic structure having a strongly reduced pole gap in the hill sectors and a very large pole gap in the valley sectors, combined with one circular shaped return yoke placed around the coils which serves to close the magnetic circuit.

Document WO93/10651 describes a compact sector-focused isochronous cyclotron having the special feature of an elliptically or quasi-elliptically shaped pole gap in the hill sectors which tends to close towards the outer radius of the hill sector and which allows to accelerate the particles very close to the outer radius of the hill sector without losing the focusing action and the isochronism of the magnetic field. This will facilitate the extraction of the beam as is pointed out later.

The second main sub-system of a cyclotron is the RF accelerating system which consists of resonating radio-frequency cavities which are terminated by the accelerating electrodes, usually called the "dees". The RF system creates an alternating voltage of several tenths of kilovolts on the dees at a frequency which is equal to the revolution frequency of the particle or a higher harmonic thereof. This alternating voltage is used to accelerate the particle when it is spiralling outwards to the edge of the pole. Another main advantage of the deep-valley cyclotron is that the RF-cavities and dees can be placed in the valleys, allowing for a very compact design of the cyclotron.

The third main sub-system of a cyclotron is the vacuum system. The purpose of the vacuum system is to evacuate the air in the gap where the particles are moving in order to avoid too much scattering of the accelerating particles by the rest-gas in the vacuum tank and also to prevent electrical sparks and discharges created by the RF system.

The fourth sub-system is the injection system which consists basically of an ion source in which the charged particles are created before starting the accelerating process. The ion source can be mounted internally in the centre of the cyclotron or it can be installed outside of the machine. In the latter case the injection system also includes the means to guide the particles from the ion source to the centre of the cyclotron where they start the acceleration process.

When the particles have completed the acceleration and have reached the outer radius of the pole sectors they can be extracted from the machine, or they can be used in the machine itself. In the latter case an isotope production target is mounted in the vacuum chamber. The main disadvantage of this is however, that the particles partly scatter away from the target and then become lost in an uncontrolled manner all over the vacuum tank. This may cause a strong radio-activation of the machine.

In many applications it is wished to bring the beam outside of the machine and guide it to a target where it can be used. In this case an extraction system is installed near the outer radius in the machine. The beam extraction is considered as one of the most difficult processes in generating a cyclotron beam. It basically consists in bringing the beam in a controlled manner from the acceleration region to an outer radius where the magnetic field is low enough so that the beam can freely exit the machine.

For extracting positively charged particles the common method is to use an electrostatic deflector which produces on outward electric field which pulls the particles out of the confining influence of the magnetic field. To achieve this action, a very thin electrode called septum is placed between the last internal orbit in the machine and the orbit that will be extracted. However, this septum always intercepts a certain fraction of the beam and therefore this extraction method has two main drawbacks. The first one is that the extraction efficiency is limited, thereby limiting the maximum beam intensity that can be extracted due to thermal heating of the septum by the intercepted beam. The second is that interception of particles by the septum contributes strongly to the radio-activation of the cyclotron.

Another well known extraction method concerns negatively charged particles. Here the extraction is obtained by passing the beam through a thin foil wherein the negative ions are stripped from their electrons and are converted into positive ions. This technique allows for an extraction efficiency close to 100% and furthermore an extraction system which is considerably simpler then the previous one. However, also here there is a main disadvantage caused by the fact that the negative ions are not very stable and therefore easily get lost by collisions with the rest gas in the vacuum tank or by too large magnetic forces acting on the ion. This beam loss again causes unwanted radio-activation of the cyclotron. Furthermore, cyclotrons accelerating positive ions allow to produce higher beam intensities with a higher reliability of the accelerator and at the same time allow a strong reduction in size and weight of the machine.

Also known from the publication "The Review of Scientific Instruments, 27 (1956), No. 7" and from the publication "Nuclear Instruments and Methods 18, 19 (1962), pp. 41–45e by J. Reginald Richardson, is a claim of a method where the beam could be extracted from the cyclotron without the use of an extraction system. The conditions needed for this auto-extraction are certain resonance conditions of the particle orbits in the magnetic field. However, this method will be difficult to realise and also would give such a bad extracted optical beam quality that in practice it will never be applied.

Also known is the document U.S. Pat. No. 3024379 which reports on a cyclotron system in which the magnetic field is essentially independent on the azimuthal angle. This means that this is a non-isochronous cyclotron. It should be noted that the cyclotron described here includes means for extraction of the beam that consists of "regenerators" and "compressors" which allow, by perturbing the magnetic field, an extraction of the beam.

Document EP-0853867 describes a method for extraction from a cyclotron in which the ratio between the pole gap in the hill sector near the maximum radius and the radial gain per turn of the particles at the same radius is lower than 20 and in which the pole gap in the hill sector has an elliptical or quasi-elliptical shape with a tendency to close at the maximum radius of the hill sector and in which at least one of the hill sectors has a geometrical shape or a magnetic field which is essentially asymmetric as compared to the other hill sectors. The present invention relies among others on this narrow quasi-elliptical pole gap and the asymmetry of at least one sector and at the same time outlines the kind of asymmetries that can be applied to obtain the auto-extraction of the beam.

AIMS OF THE INVENTION

The aim of the present invention is to propose a new method for extraction of charged particles from a cyclotron without using a stripping mechanism or an electrostatic deflector as it has been described above.

An additional aim is to obtain in this way an isochronous cyclotron who is more simple in concept and also more economical than those which are presently available.

Another additional aim is to increase the extraction efficiency and the maximum extracted beam intensity especially for positively charged particles.

MAIN CHARACTERISTICS OF THE PRESENT INVENTION

The present invention is related to a superconducting or non-superconducting isochronous sector-focused cyclotron, comprising an electromagnet with an upper pole and a lower pole that constitutes the magnetic circuit, the poles being made of at least three pairs of sectors called "hills" where the vertical gap between said sectors is small, these hill-sectors being separated by sector-formed spaces called "valleys" where the vertical gap is large, said cyclotron being energised by at least one pair of main coils, characterised in that at least one pair of upper and lower hills is significantly longer than the remaining pair(s) of hill sectors in order to have at least one pair of extended hill sectors and at least one pair of non-extended hill sectors and in that a groove or a "plateau" which follows the shape of the extracted orbit is present in said pair of extended hill sectors in order to produce a dip in the magnetic field.

According to one preferred embodiment, the radial width of the groove is limited to a few centimetres, preferably of the order of 2 cm, such that it is completely located on the extended hill sector.

According to an alternative embodiment, the outer border of the groove may also be moved beyond the radial extremity of the extended hill sector, in which case a kind of "plateau" is formed which is however still characterised by the stepwise increase of the vertical hill gap and the related sudden decrease of the magnetic field near the inner border of the "plateau".

Preferably, the vertical gap in the nonextended hill sectors as well as the vertical gap in the extended hill sectors has essentially an elliptical profile which tends to close towards the median plane at the radial extremity of the hill sectors.

According to one preferred embodiment, at least one set of harmonic coils is placed in the vertical hill gap, said coils having essentially the shape of the local orbit at that place. Said coils serving to add a first harmonic field component to the existing magnetic field and to increase the turn separation at the entrance of the groove.

According to another preferred embodiment, the vertical hill gap profiles onto azymuthally opposite hill sectors is deformed such that one profile shows a profound bump on the last turn of the orbit and the other profile shows a profound dip on the last turn of the orbit. Said deformation serves to add a first harmonic field component to the existing magnetic field and to increase the turn separation at the entrance of the groove.

According to a third preferred embodiment, an arrangement of permanent magnets is placed in two opposite valleys such that in one valley a sharp magnetic field bump is created on the last turn of the orbit and in the opposite valley a magnetic field dip is created on the last turn of the orbit. Said arrangement serves to add a first harmonic field component to the existing magnetic field and to increase the turn separation at the entrance of the groove.

Preferably, a gradient corrector will be present at the exit of the groove. Such gradient corrector comprises unshielded permanent magnets and shows a completely open vertical gap as well as small compensating permanent magnets in order to minimise the perturbing magnetic field at the internal orbit.

Advantageously, a lost beam stop is provided behind the exit of the gradient corrector at an azimuth where there is a significant turn separation between the extracted beam and the last turn of the orbit. Said beam stop is placed such that it intercepts the bad parts of the internal beam as well as the extracted beam.

Preferably, in the return yoke, a pair of horizontally and vertically focusing quadrupoles is placed after the vacuum exit port which are made of unshielded permanent magnets.

The present invention is also related to a method for the extraction of a charged particle beam from a isochronous sector-focused cyclotron as described hereabove, wherein a sharp dip in the magnetic field on the last turn of the orbit will be used in order to extract the beam of particles without the help of an electrostatic deflector or a stripper mechanism.

SHORT DESCRIPTION OF THE DRAWINGS

Figure 6A:
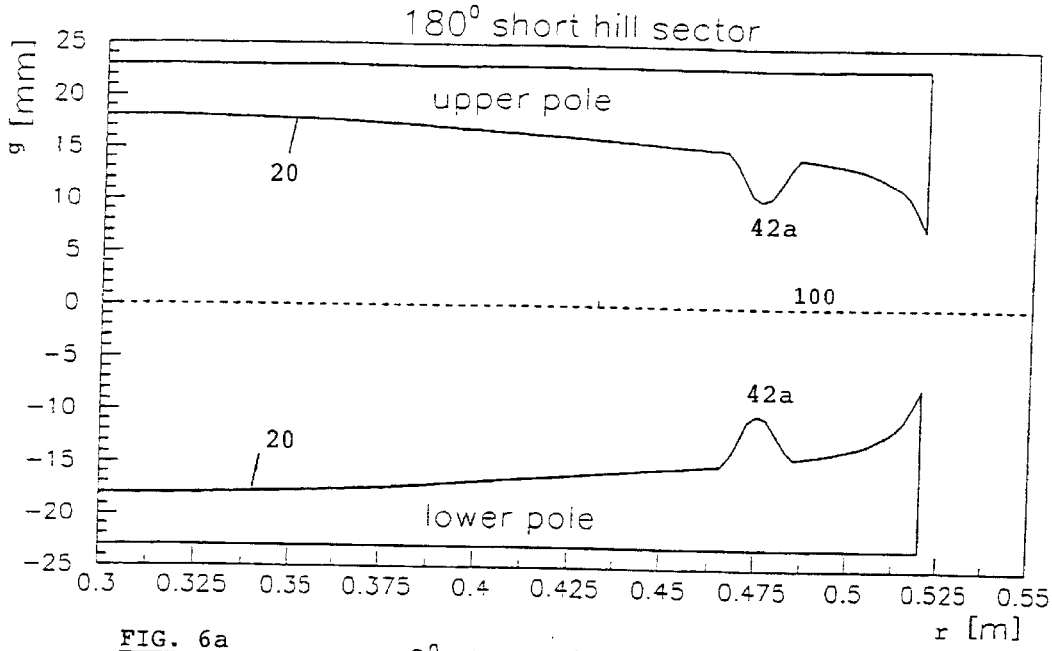
Figure 6B:
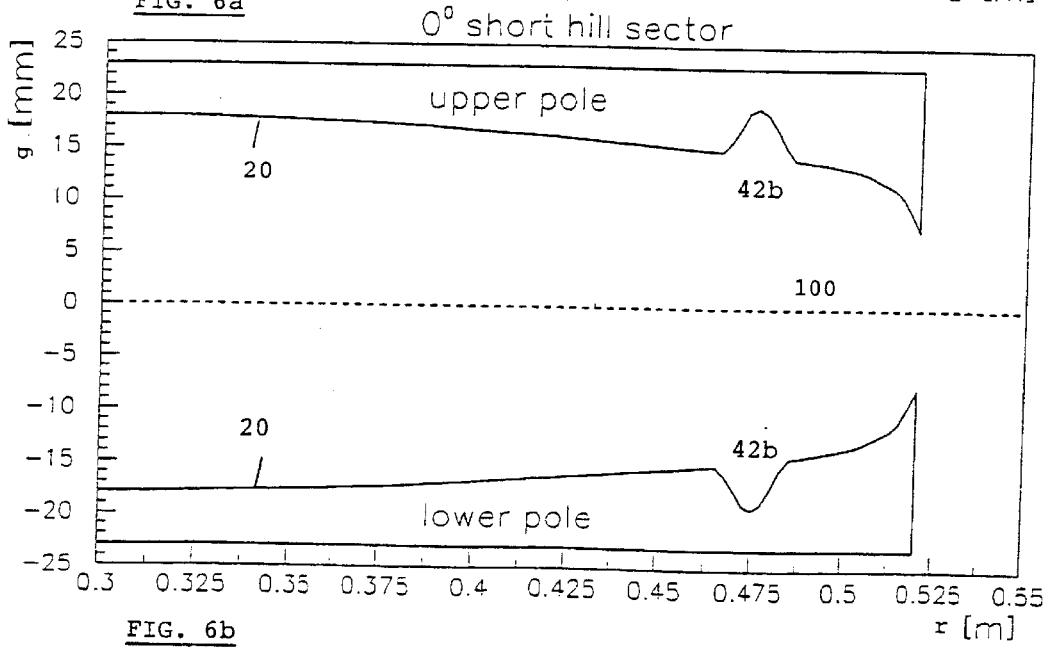

FIGS. 6*a* and 6*b* are representing the hill gap profiles in opposite sectors for a compact sector-focused cyclotron according to another preferred embodiment of the present invention.

Figure 7:
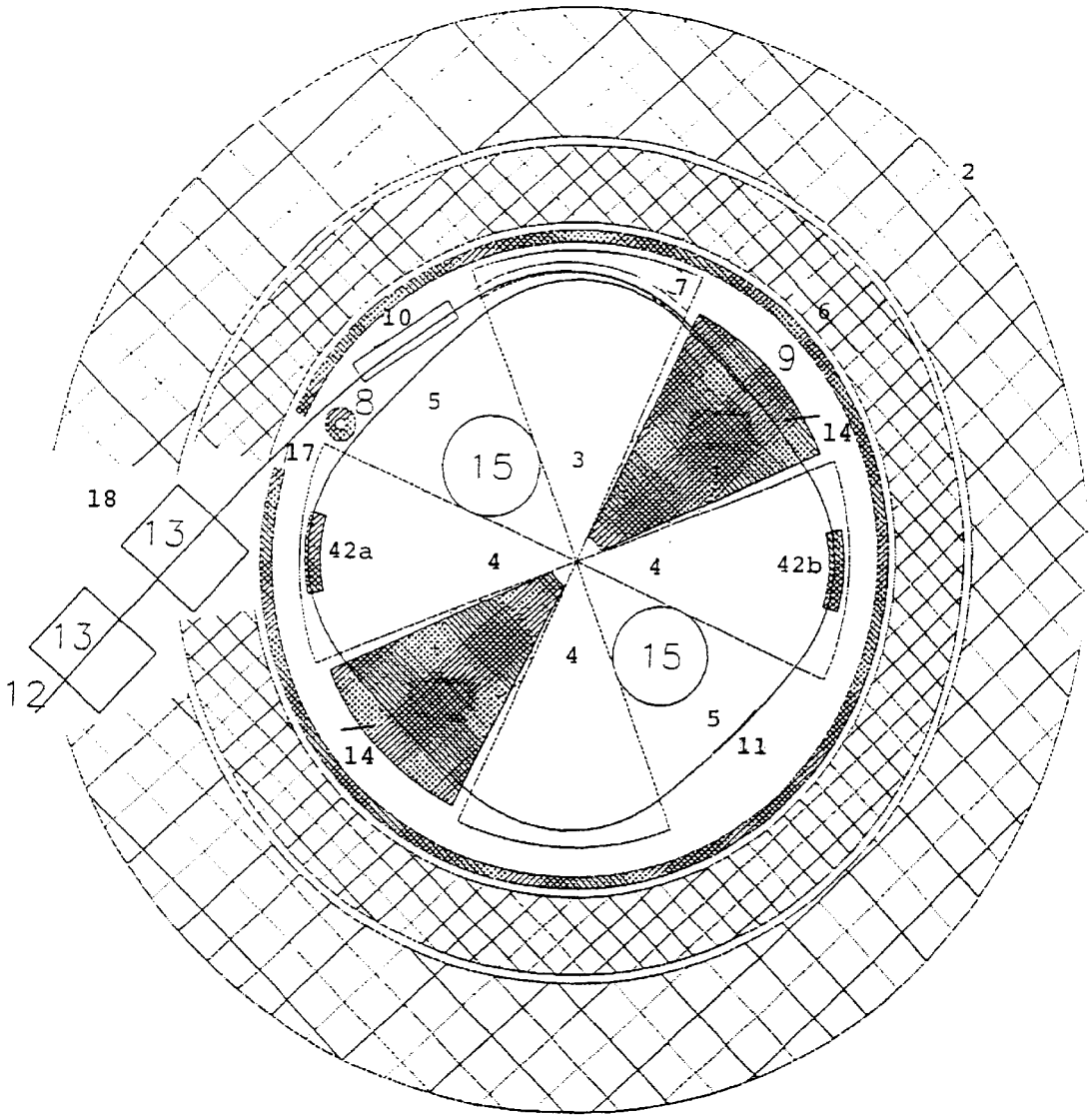

FIG. 7 is representing a view in the median plane for a compact sector-focused cyclotron as having the hill gap as represented in FIGS. 6*a* and 6*b*.

Figure 8:
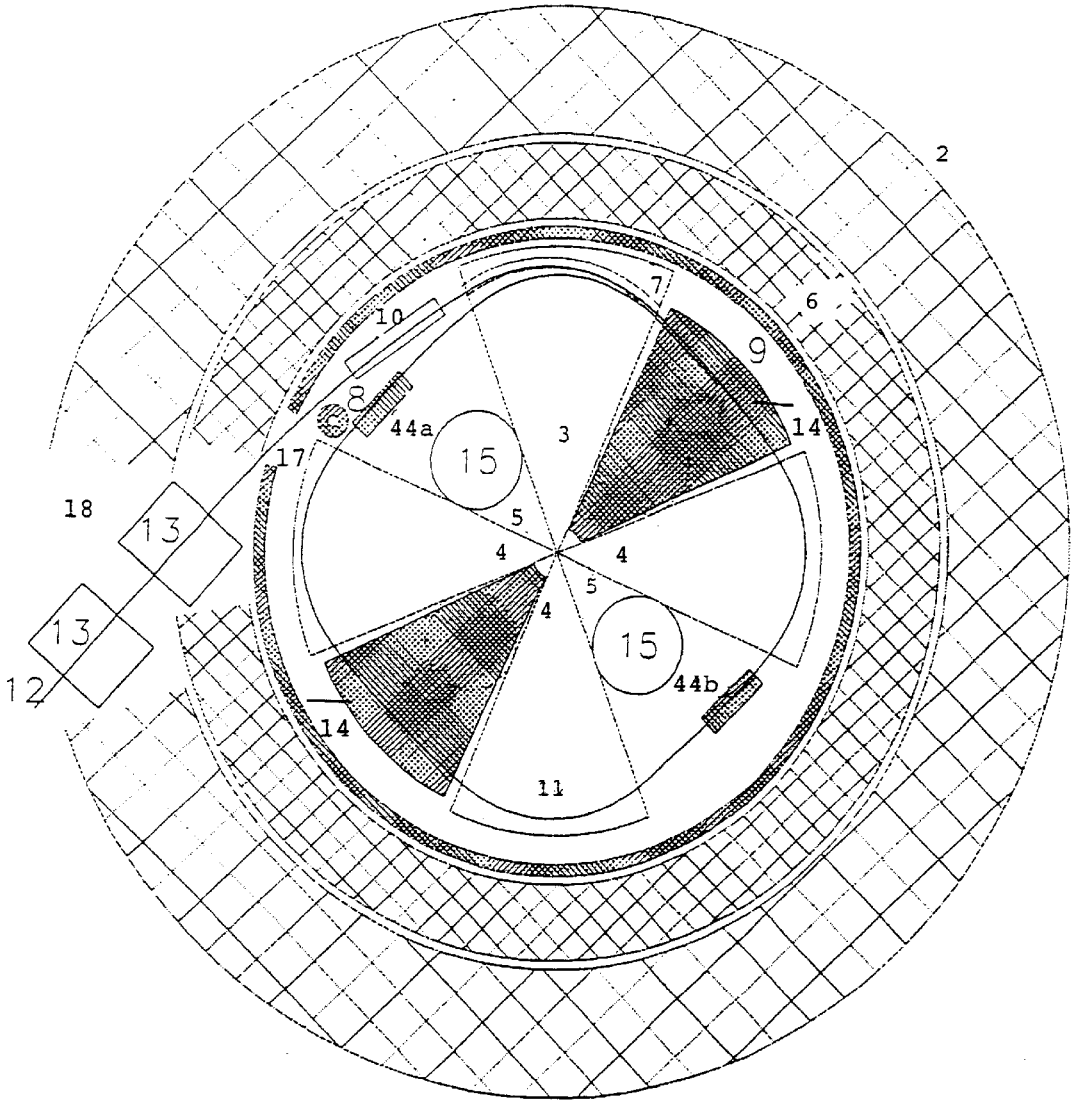

FIG. 8 is representing a view in the median plane of a compact sector-focused cyclotron as a third preferred embodiment of the present invention.

Figure 9:
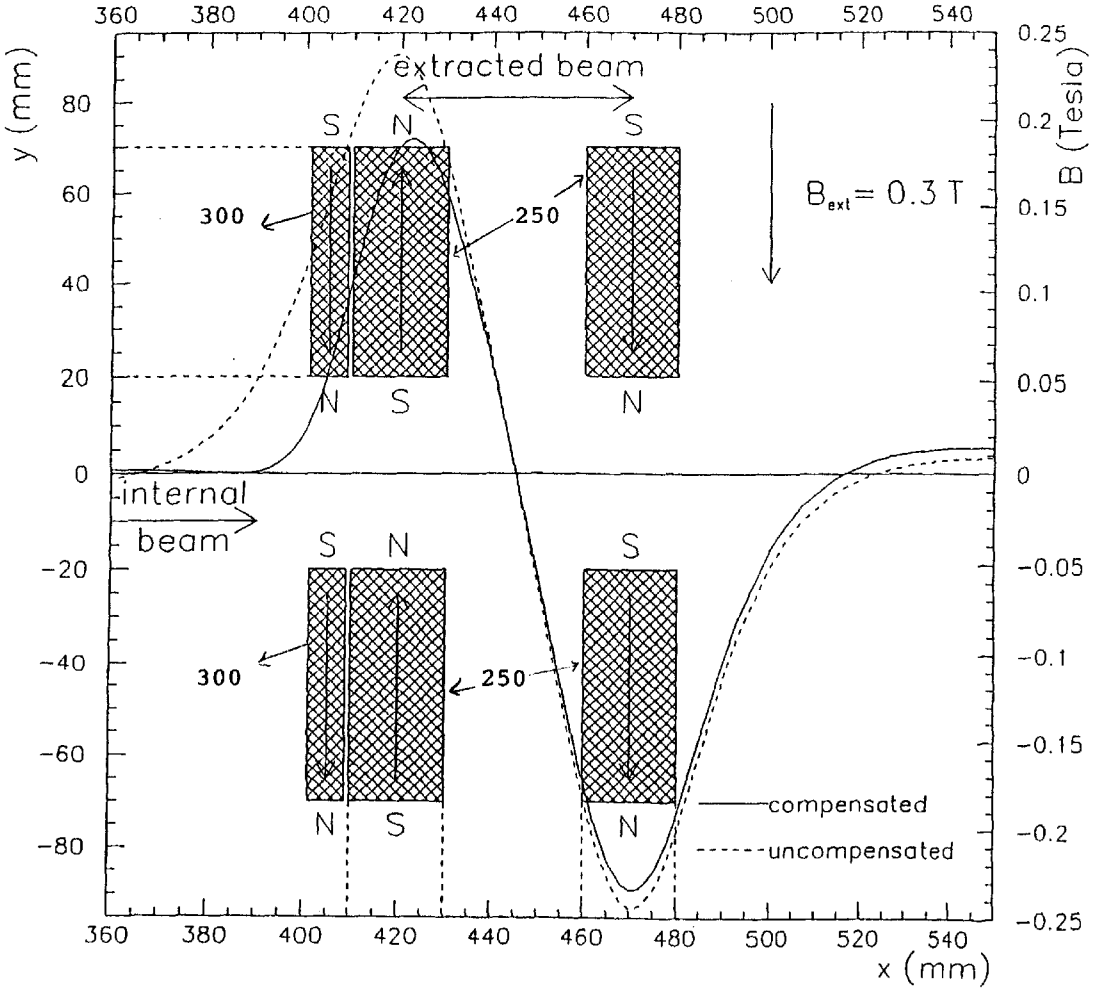

FIG. 9 is representing the schematic vertical cross-section through the gradient corrector showing the configuration of the permanent magnets and the shape of the magnetic field.

Figure 10:
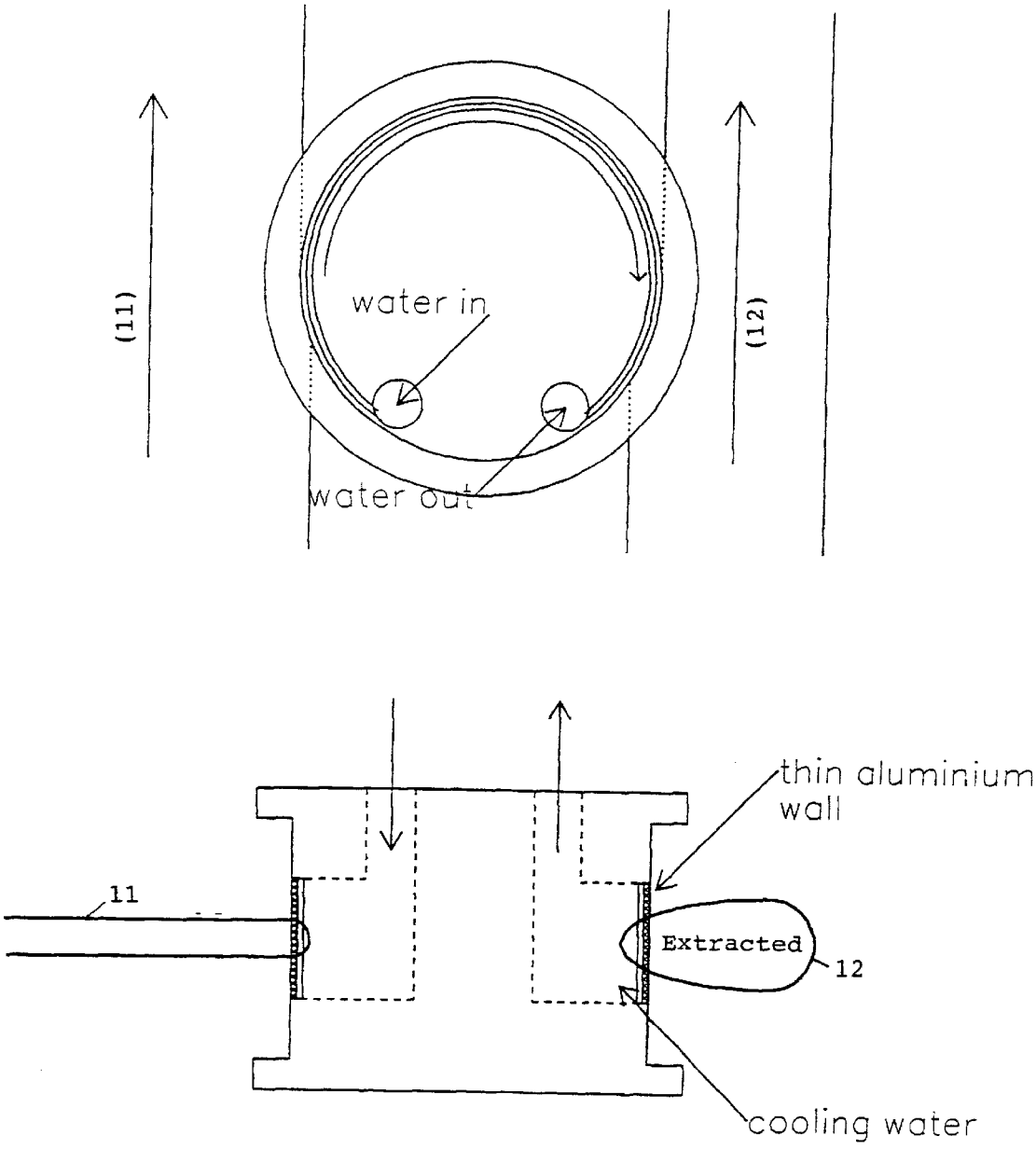

FIG. 10 is representing horizontal and vertical cross section through the lost beam dump explaining the cooling mechanism.

Figure 11:
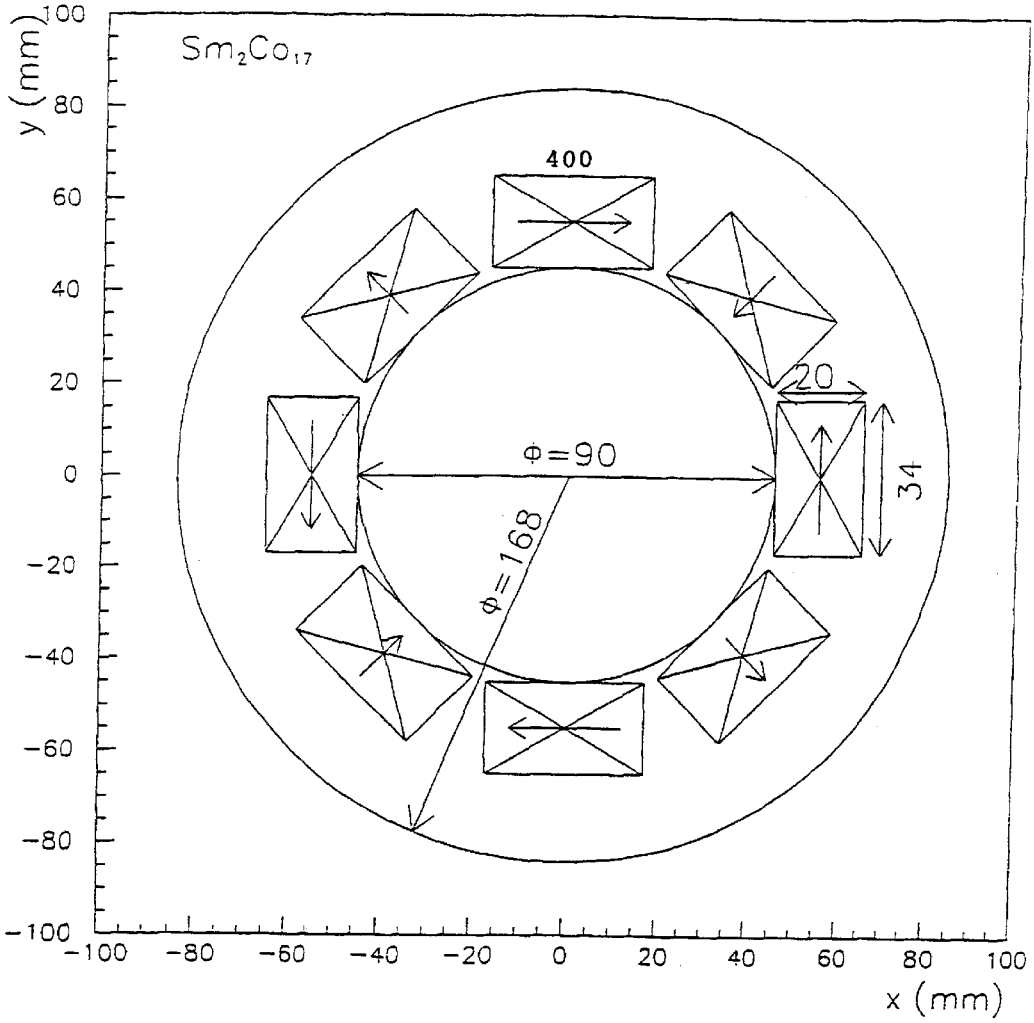

FIG. 11 is representing the vertical cross section through the permanent magnet quadrupoles placed in the exit port of the return yoke.

DETAILED DESCRIPTION OF SEVERAL EMBODIMENTS OF THE PRESENT INVENTION

Figure 1:
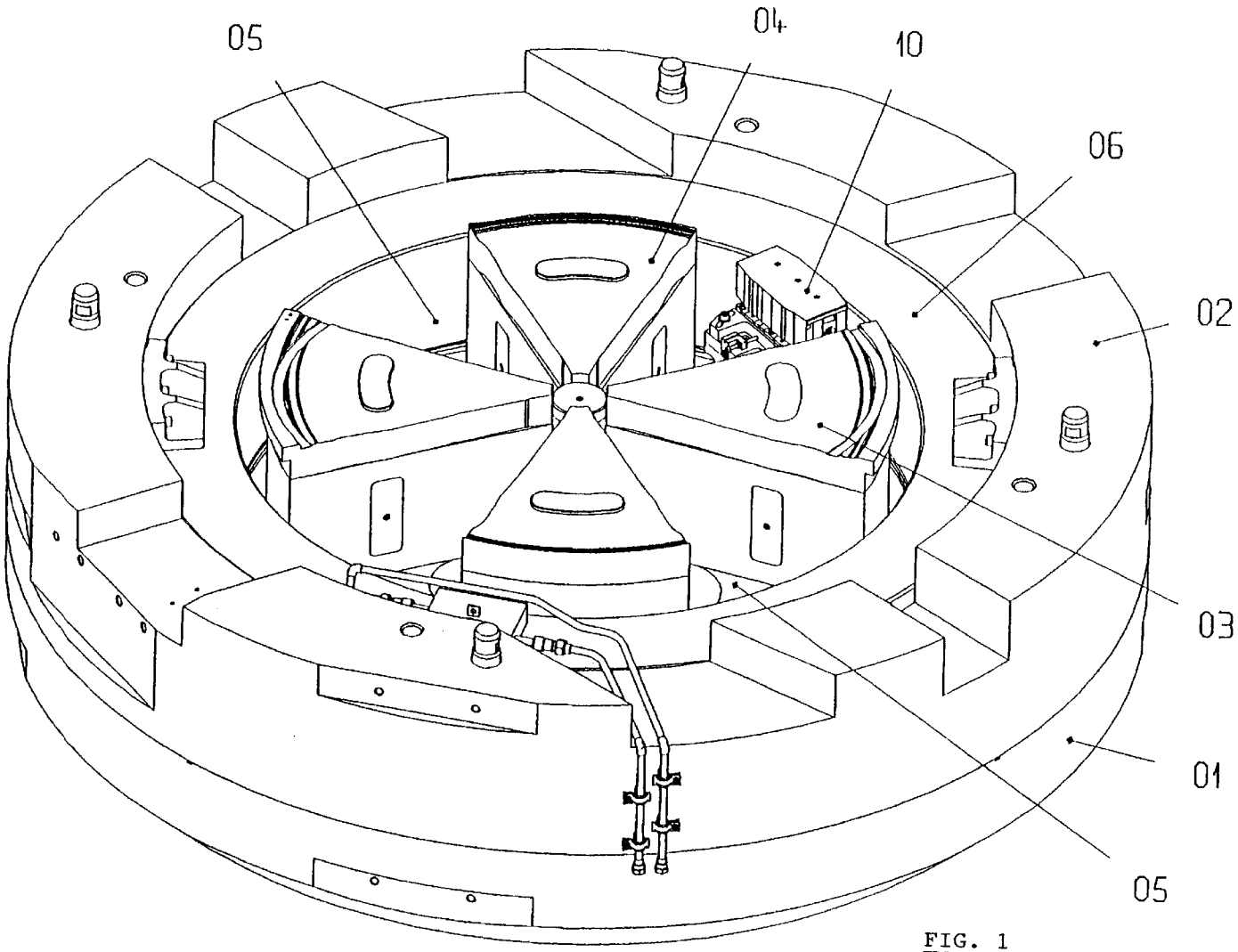
FIG. 1 is representing a 3-dimensional view of the lower half of a magnetic circuit for a compact sector-focused cyclotron according to a preferred embodiment of the present invention.
Figure 2:
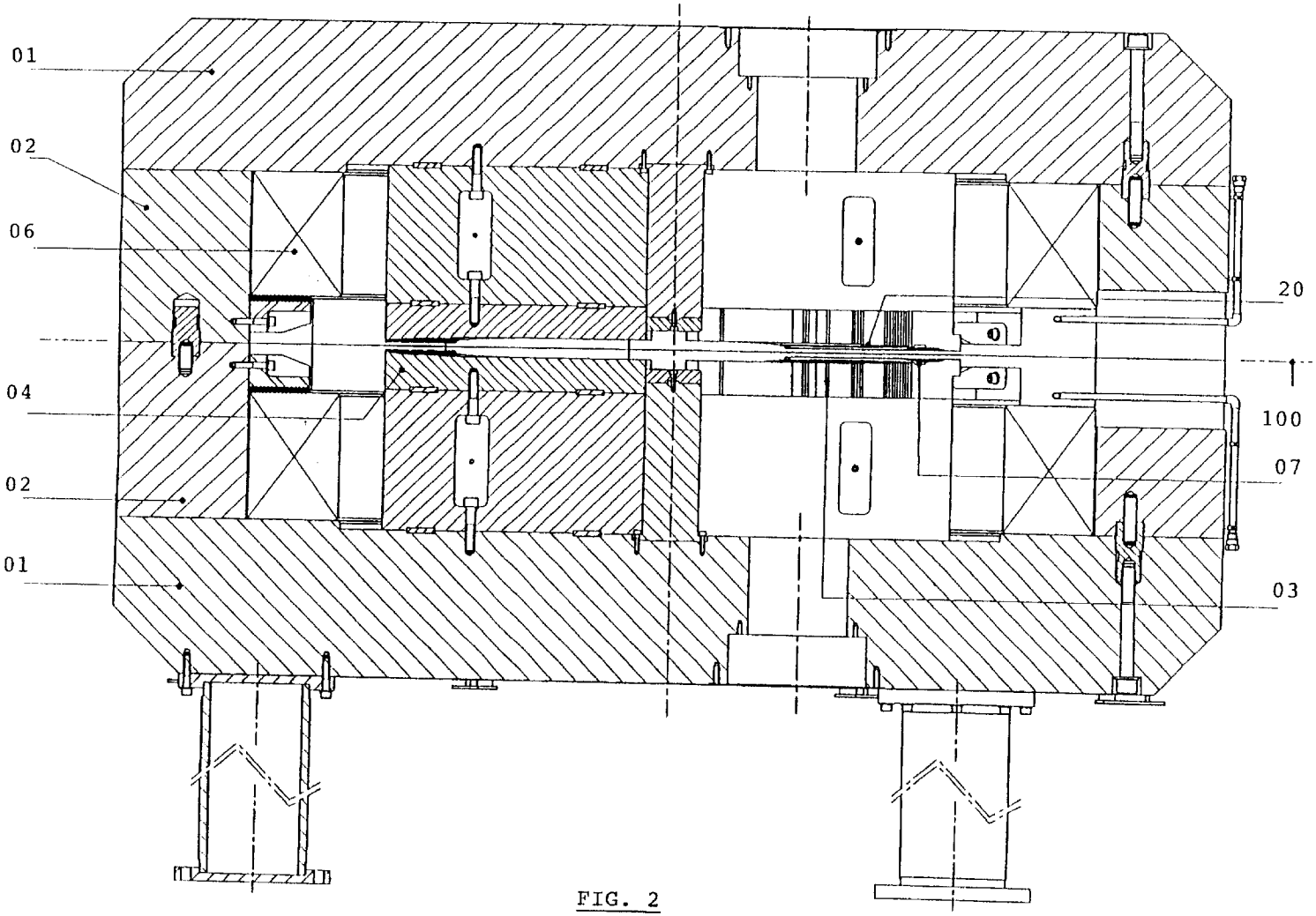
FIG. 2 is representing a vertical cross-section of the magnetic circuit as represented in FIG. 1.

The present invention concerns a new method for the extraction of charged particles from a compact isochronous sector-focused cyclotron. The most important sub-system of the cyclotron is the magnetic circuit, created by an electromagnet as represented by the FIGS. 1 and 2, that consists of the following main elements:

- two base plates (1) and the flux return (2) which connect together and form a rigid-structure called the yoke;
- at least 3 upper and 3 lower hill sectors, and preferably 4 upper and 4 lower hill sectors (3,4) as represented in FIGS. 1 and 2, which are located symmetrically with respect to the symmetry plane called the median plane (100) and having a vertical gap in the centre of about 36 mm and a vertical gap of about 15 mm at the extraction region;
- between each two hill sectors there is sector where the vertical gap is substantially larger than the hill gap and which is called the valley sector (5), with a vertical gap of about 670 mm;
- two circular coils (6) which are positioned in between the hill sectors and the flux returns (2).

The extraction method is characterised by the fact that there is no electrostatic deflector or stripper mechanism installed in the cyclotron. The extraction method is further characterised by the fact that the vertical gaps in the hill sectors have a quasi-elliptical profile (20) that narrows towards the radial extremity of the hill sectors. The extraction method is further characterised by the fact that at least one pair of the hill sectors (3) of the cyclotron is significantly longer (about a few centimetres and preferably around 4.0 cm) than the other pair of hill sectors (4).

In a cyclotron, the beam is confined within the region of the magnetic field by a force, called the Lorentz force. This force is proportional to the magnitude of the magnetic field and also proportional to the velocity of the particle. It is directed perpendicular to both the direction of the magnetic field and the direction of the particle orbit and points approximately towards the centre of the cyclotron.

When the particle has reached the radial edge of the pole, extraction can be obtained, if the force acting on the particle is suddenly substantially reduced, so that it is no longer big enough to keep the particle in the confining region of the magnetic field. An essential point here is that this reduction of this force must be realised over a small radial distance so that the last internal orbit is not disturbed.

A common way to obtain this sudden reduction of the Lorentz force is, to install an electrostatic deflector. In this device an electrostatic field is created between a very thin inner septum and an outer electrode. This deflector produces an outwardly directed electrical force that counteracts the Lorentz force. The septum, placed between the last internal orbit and the extracted orbit, is electrically at ground potential so that there is almost no perturbation of the internal orbit. However, the main disadvantage of using the electrostatic deflector is that the septum intercepts a certain fraction of the beam. Due to this it becomes radio-activated and also heats up and therefore limits the maximum extraction efficiency and beam intensity.

Figure 3:
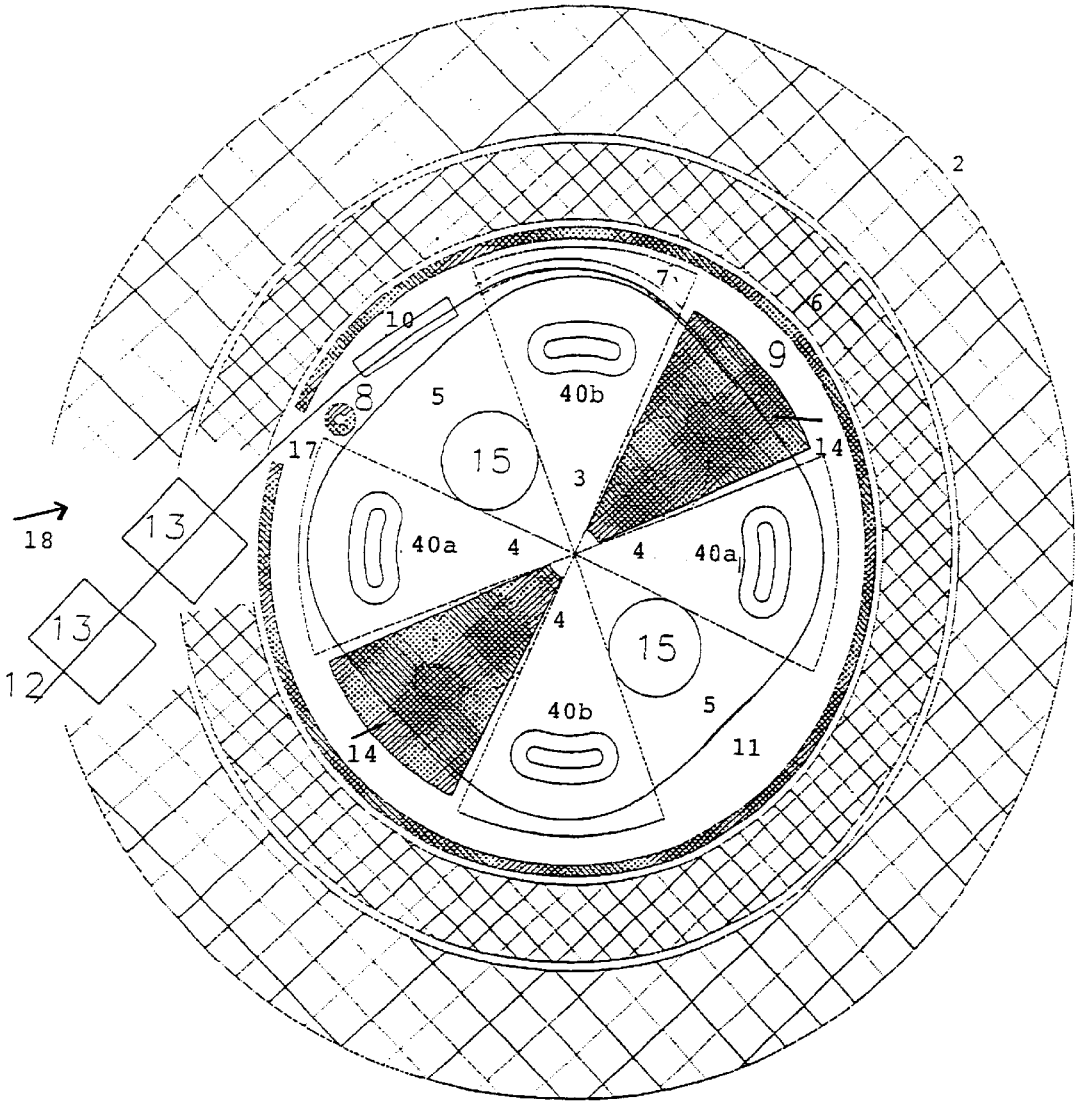
FIG. 3 is representing a view in the median plane of a compact sector-focused cyclotron according to the present invention according to a first preferred embodiment.

The proposed extraction scheme of the present invention is illustrated in FIG. 3 showing the median plane view of the cyclotron. A compact deep valley cyclotron similar to the one described in the document EP-A-0222786 will be the preferred cyclotron for implementing the present invention. Therefore such a cyclotron with 4-fold symmetry consisting in four hill sectors (3, 4) and four valley sectors (5) has been taken as an example. However, similar embodiments with 3-fold symmetry or higher than 4-fold symmetry are also possible. Several items as discussed before are shown in FIG. 3, such as the hill and valley sectors, the vacuum chamber (9), the circular coils (6), the return yoke (2) and the accelerating electrodes (14). Also shown is the last full turn (11) in the cyclotron and the extracted beam (12).

One important feature of the present invention is, that the required sudden reduction of the Lorentz force is created by a fast decrease of the magnetic field near the edge of the pole. In order to realise a fast enough drop in the magnetic field, the vertical gap between the poles in the hill sector must be small Preferably, the ratio between the vertical gap in the hill sector near the maximum radius and the radial gain per turn of the particles at this radius should be less than about 20.

Advantageously, the profile of the vertical gap in the hill sector near the outer radius of the pole has an elliptical or quasi-elliptical (20) shape with a tendency to close towards the maximum pole radius. Such a profile allows to accelerate the particles very close to the outer radius of the hill sector without losing the focusing action and the isochronism of the magnetic field and also to create a magnetic field which shows a very steep fall-off just beyond the radius of the pole. As a consequence, the magnetic force which is acting on the extracted orbit is substantially lower than the same force acting on the last internal orbit.

Another new important feature of the present invention is that at least one pair of the hill sectors (3) in the cyclotron is significantly longer than the other pairs of hill sectors (4). This extension of at least one pair of hill sectors gives an extension of the magnetic field map on this sector which can be shaped to optimise the extraction process and the optical properties of the extracted beam.

Figure 4:
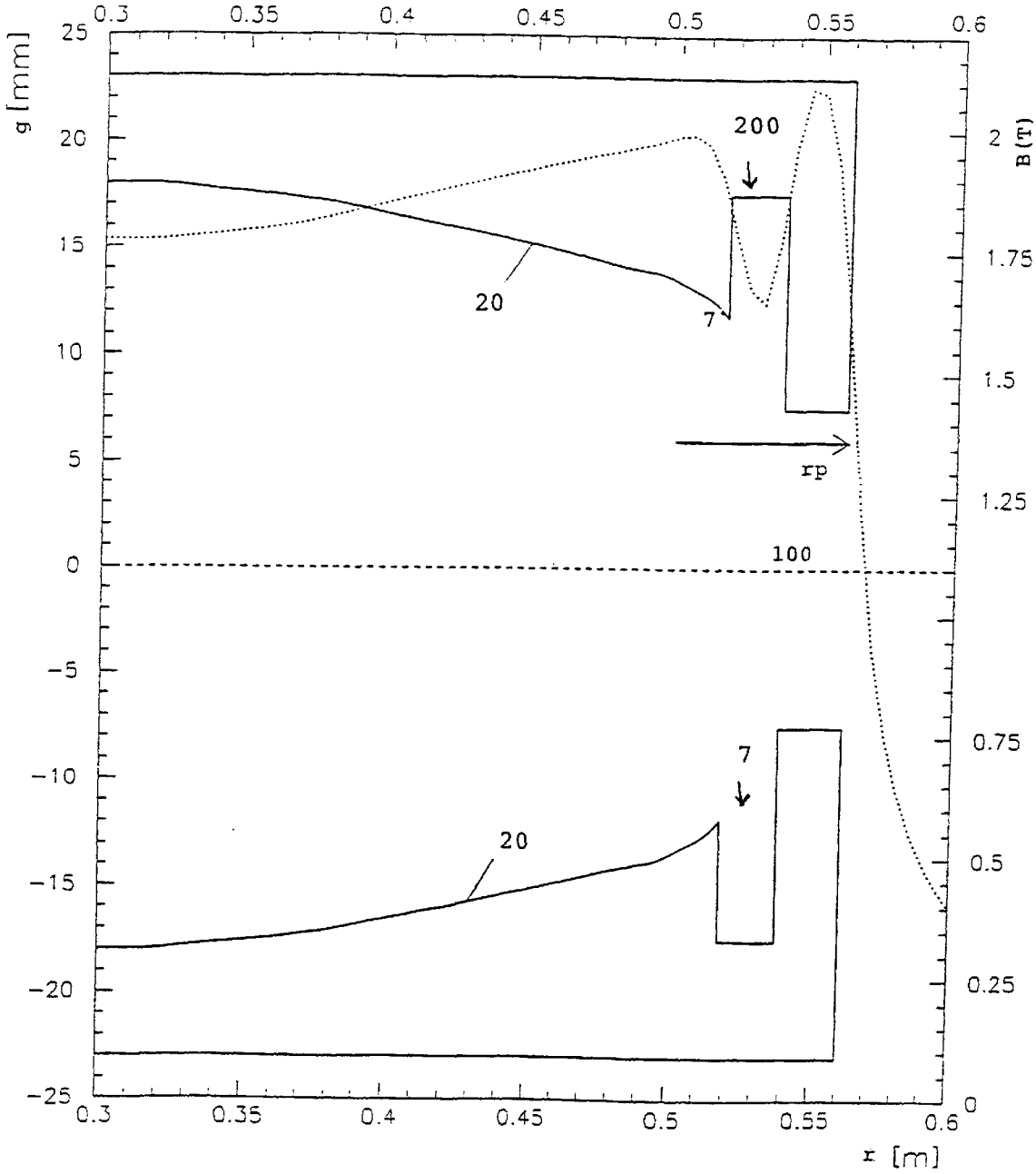
FIG. 4 is representing a vertical cross section of the extended hill sector for one first preferred embodiment of the present invention.

Another new important feature of the present invention is that in the above described extension of the hill sector, a groove (7) is machined which follows the shape of the extracted beam (12) on this sector and which, in combination with the small gap in the hill sector and the quasi-elliptical gap profile (20) as described above, produces the required sudden reduction in the magnetic field and in the Lorentz force. The effect of this groove (7) is comparable to that of the electrostatic deflector and one could say that it replaces the electrostatic deflector. In fact the groove produces a sharp dip in the magnetic field in the sense that, as a function of radius, the field is sharply falling to a minimum but then rises again to more or less the same initial value. This is important because it prevents that the quality of the extracted beam gets destroyed due to the well-known horizontally defocusing action of a falling magnetic field snape. The geometry of the groove is illustrated in FIG. 4, together with the quasi-elliptical shape of the gap in the hill sector. This figure also shows the magnetic field shape and especially the sharp dip (200) in the field as produced by the groove (7).

Figure 5:
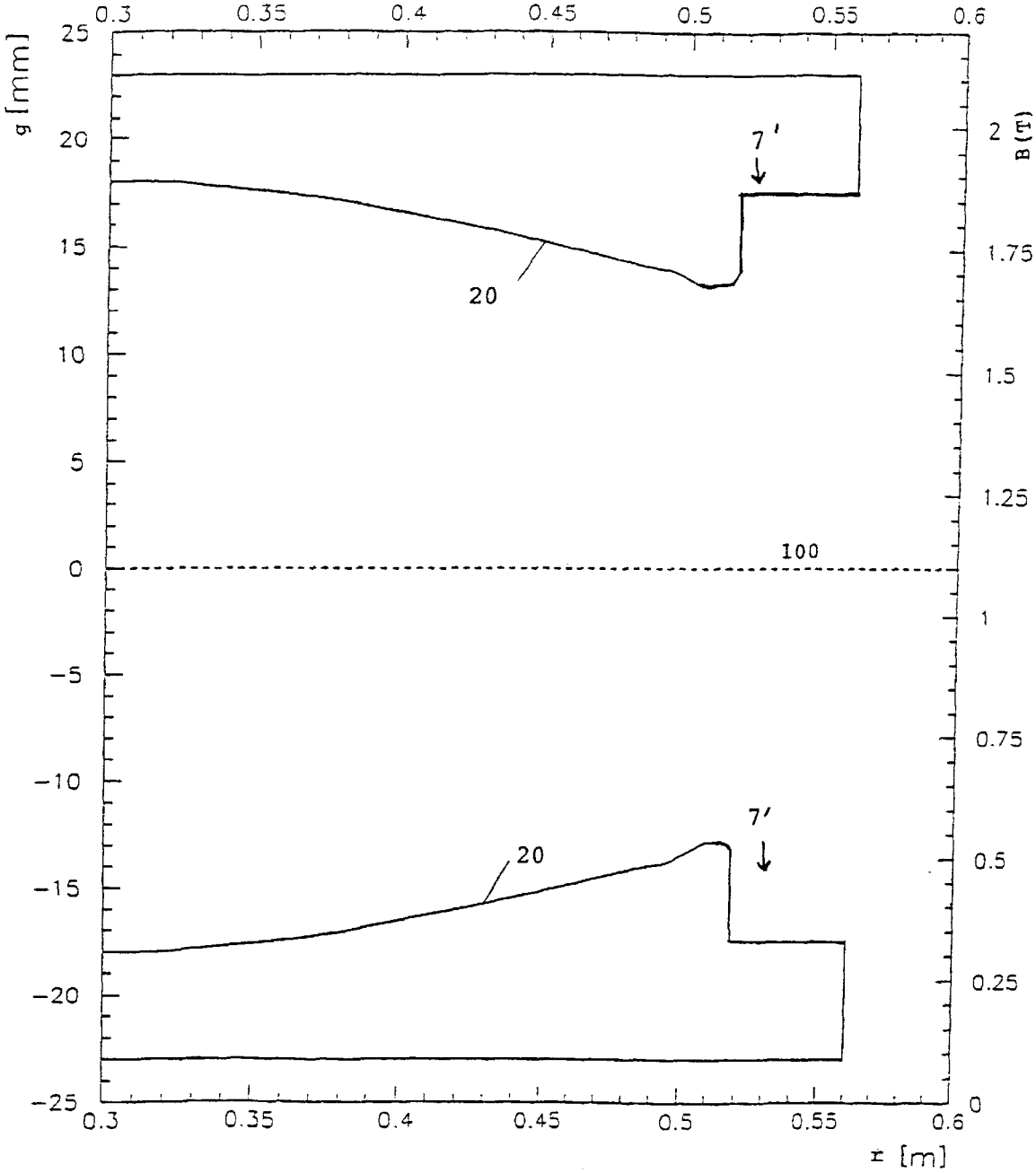
FIG. 5 is representing a vertical cross section of the extended hill sectors for an alternative preferred embodiment of the present invention.

According to another preferred embodiment, more precisely described in FIG. 5, the outer border of the groove may also be moved beyond the radial extremity of the extended hill sector, in which case a kind of "plateau" (7') is formed which is however still characterised by the stepwise increase of the vertical hill gap and the related sudden decrease of the magnetic field (not represented) near the inner border of the "plateau" (7').

It should be noted that the density distribution of the beam in the cyclotron is a continuous profile showing a maximum on the centroid of a turn and a non-zero minimum in between two turns. The particles situated at this minimum may give rise to beam losses in the extraction process. This beam loss can be substantially reduced by augmenting the turn separation between the last internal orbit in the machine and the extracted orbit at the azimuth where the groove is located. Besides the sudden reduction of the Lorencz force, this is the second crucial ingredient for an efficient extraction of the beam.

According to the present invention, three independent methods are proposed for augmenting the turn separation near the extraction radius. All these three methods rely on the creation of a first harmonic Fourier component in the cyclotron magnetic field upstream of the extraction radius. A first harmonic field component is characterised by the fact that its magnetic field behaves like a sine-function or cosine-function of the azimuthal angle with a period of 360 degrees. With a proper choice of the amplitude and the azimuthal phase of such a first harmonic field component, a coherent oscillation of the beam is produced which results in the increased turn separation at the desired location in the cyclotron.

According to a first preferred embodiment, the method for increasing the turn separation is characterised by the use of small harmonic correction coils (40*a* and 40*b*) at a lower radius in the machine. A possible configuration represented in FIG. 3 is to install in one hill gap an upper and lower coil (40*a*) which produce a positive field component and on the opposite sector a same pair of coils which produce a negative field component. With such a first set of harmonic coils the amplitude of the coherent oscillation can be varied but the phase is fixed. However, for this first preferred embodiment, the beam still has to make several tuns between the radius of the harmonic coils and the extraction radius, and then an adjustment of only the amplitude of the coherent oscillation is not sufficient. A more flexible configuration is, where a second set of coils is installed at an azimuthal angle of 90 degrees with respect to the first set. With such a configuration the amplitude as well as the phase of the coherent oscillation can be varied. Other configurations are possible, where instead of four pairs of harmonic coils three pairs are used which are mounted azimuthally 120 degrees apart. This would be a preferred configuration for a cyclotron with 3-fold symmetry.

According to a second preferred embodiment, the method for increasing the turn separation is characterised by modifying the profile of the hill gap of the two sectors which are located at azimuths of +90 degrees and −90 degrees with respect to the extended hill sector in such a way that in one sector the gap profile contains a bump and thus closes rapidly and then opens again and on the opposite sector the gap profiles contain a dip and thus rapidly opens and then closes again. Both hill gap profiles are illustrated in FIGS. 6*a* and 6*b*. This extraction scheme is an alternative for the previous method and is illustrated in FIG. 7. Here the reference (42*a*) shows the required approximate position of the bump and the reference (42*b*) the required approximate position of the dip. This configuration produces a strong first harmonic component of which the azimuthal phase is 90 degrees with respect to the azimuth where the groove is located. In this method, there is only one turn between the radius of the first harmonic and the extraction radius, and therefore a possibility for adjusting the phase of the first harmonic is not needed. Ideally the radial profile and the radial location of this first harmonic on the hill sector is such that the last turn in the machine is strongly influenced by this perturbation and the last minus one turn is not influenced. This requires a sudden change in magnetic field profile which again is only possible when the vertical gap in the hill sector is small enough as has been claimed before.

According to a third preferred embodiment represented in FIG. 8, the method for increasing the turn separation is characterised by placing permanent magnets (44*a* and 44*b*) in two opposite valleys such that in one valley a positive vertical field component is produced and in the opposite valley a negative vertical field component. As far as the beam optical behaviour is concerned, this method is equivalent to the previous method. The permanent magnets should be located at azimuths of approximately +90 degrees and −90 degrees with respect to the azimuth of the entrance of the groove and at a radius such that the last turn in the machine is influenced by their magnetic field and the last minus one turn is not influenced. This method takes advantage of the fact that in the valley sectors the magnetic field level is low enough to allow the use of permanent magnet materials without having the complication of possible de-magnetisation of these magnets. Also here a sharp gradient in the radial profile of the first harmonic component is required. This can be obtained by a special configuration of the permanent magnets as will be discussed later. This extraction scheme, which is an alternative for the previous two methods, it illustrated in FIG. 8. Here, the references (44*a*) and (44*b*) indicate the approximate location in the cyclotron of the permanent magnets that produce the required first harmonic field component.

When the extracted beam exits from the extended hill sector it is horizontally diverging due to the optical influence of the magnetic field shape produced by the groove. In order to re-focus the beam, a gradient corrector is installed in the valley at the exit of the groove. In the drawings, this gradient corrector is denoted by reference (10).

Preferably, the design of this gradient corrector has the following characteristics:

- it is designed of permanent magnets and does not use iron or other soft ferro-magnetic material to shield the permanent magnets; this is possible because of the relative low external magnetic field in the valley,
- there is almost no perturbation of the internal orbits in the cyclotron,
- there is a completely open vertical gap and therefore no unwanted interception of a part of the beam by obstacles in the median plane.

FIG. 9 shows a schematic vertical cross section through the gradient corrector. The radial position of the extracted beam as well as the internal beam is indicated in this figure. The required negative gradient of the magnetic field is basically obtained with the four larger permanent magnets (250) having the indicated polarity. However, on the inner side two additional smaller permanent magnets (300) are placed which serve to compensate the magnitude of the perturbing magnetic field at the position of the internal beam. The shape of the magnetic field obtained in this way is indicated in FIG. 9 by the solid line. As a comparison also the magnetic field is given that would be obtained without this compensation (dashed line).

A similar design as illustrated in FIG. 9 can be used for the references **(44*a*) and (44*b*) in FIG. 8** related to the extraction scheme where the first harmonic field component is produced by permanent magnets placed in the valleys. However, in this case it is not the focusing action which is exploited but the fast rise of the magnetic field at the inner radius side of the device which also is realised with the small compensating permanent magnets. As has already been mentioned before, such a sharp rise is required in order to achieve that the last turn is strongly influenced by the first harmonic field component but the last minus one turn is not.

Advantageously, one can suggest the use of the lost beam stop (8) in the several embodiments represented in FIGS. 3, 7 and 8. The purpose of this beam stop is, to intercept the small fraction of the beam which is not properly extracted and which would otherwise radioactivate or damage unwanted parts of the cyclotron. The beam loss on this beam stop is comparable with the beam loss on the septum as occurs in the conventional extraction method using the electrostatic deflector. However, the main advantage of the suggested extraction methods is that this beam stop can be installed at a place where the turn separation between the internal beam and the separated beam is already in the order of 10 cm. Due to this, the beam density of the lost beam is substantially reduced and water-cooling is much easier and more efficient. The problem of thermal heating is therefore much less than that of the septum. Furthermore, the design and the construction material of the beam stop can be optimally chosen in order to dissipate almost all of the heat in the cooling water and to minimise the production of neutron radiation. In the case of an electrostatic deflector, this choice is not free because of the presence of high electrical fields. The use of the lost beam stop will allow to extract much higher intensities than can be obtained via the conventional extraction with an electrostatic deflector. FIG. 10 illustrates the proposed design of the lost beam stop (8). It is designed such that it intercepts the tail on the inner side of the extracted beam (12) but also the tail on the outer side of the internal beam (11). In this way, by properly positioning the beam stop, all the low quality parts of the beam can be efficiently removed. By applying a high input pressure, the cooling water is forced with a high velocity into the narrow channel. This high velocity substantially augments the cooling efficiency. The cooling water is contained by the thin aluminium wall. Most of the heat is therefore dissipated in the water. The production of neutrons in aluminium as well as in water is low.

After passing the gradient corrector (10), the beam leaves the cyclotron via an exit port (17) in the vacuum chamber and via an exit port (18) in the return yoke (2). In this exit port a quadrupole doublet (13) is placed in order to focus the beam horizontally as well as vertically. In order to allow a compact design, the quadrupoles are made of unshielded permanent magnets (400). Here again shielding is not required because of the low external magnetic field in the exit port. FIG. 11 shows a vertical cross section through the quadrupole. The polarity of the permanent magnets (400) is indicated by the arrows. The dimensions of the permanent magnets are optimised in order to minimise the non-linear contributions in the field over the full bore of the quadrupole.

What is claimed is:

1. Superconducting or non-superconducting isochronous sector-focused cyclotron, comprising an electromagnet with at least an upper pole and at least a lower pole that constitute the magnetic circuit, the poles together being made of at least three pairs of sectors (3, 4) called "pairs of hill sectors" and separated from each other by a pair of sectors (3, 4) called "pair of valley sectors", each pair of hill sectors and each pair of valley sectors comprising an upper sector and a lower sector located symmetrically with respect to the symmetry plane of the cyclotron called the median plane (100) with a vertical gap therebetween which is small for the pairs of hill sectors and which is large for the pairs of valley sectors, said cyclotron being energised by at least one pair of main coils (6), characterised in that:

(i) at least one pair of hill sectors is significantly longer in the radial direction of the cyclotron than the remaining pairs of hill sectors in order to have at least one pair of extended hill sectors (3) and at least one pair of non-extended hill sectors (4);

(ii) at the radial extremity of said pair of extended hill sectors (3) is present a groove (7), said groove (7) or said plateau (7') following the shape of the extracted orbit and the vertical gap at said groove (7) or at said plateau (7') increasing stepwise in order to have a very steep fall-off or dip (200) in the magnetic field in the extended part of the hill sector.

2. Cyclotron according to claim 1, wherein the hill sectors (3) in the pair of extended hill sectors are longer of a few centimetres, in the radial direction of the cyclotron, preferably of between 2 and 10 centimetres, compared to the hill sectors (4) in the pairs of nonextended hill sectors.

3. Cyclotron according to claim 1, wherein the groove (7) is limited to a few centimeters such that it is completely located on the pair of extended hill sectors (3).

4. Cyclotron according to claim 1, wherein a "plateau" (7') is formed by moving the outer border of the groove beyond the radial extremity of the pair of extended hill sector (3).

5. Cyclotron according to claim 1, characterised in that the vertical gap in the non-extended hill sectors (4) as well as the vertical gap in the extended hill sectors (3) has essentially an elliptical profile (20) which tends to close towards the medial plane (100) at the radial extremity of the hill sectors.

6. Cyclotron according to claim 1, characterized in that at least one set of harmonic coils (40*a* and 40*b*), comprising a coloin producing a positive magnetic field component and a coil producing a negative magnetic field component, is placed in the vertical gap of one pair of hill sectors in a configuration such that the amplitude as well as the phase of the coherent oscillation can be varied, said coils having essentially the shape of the local orbit at that place.

7. Cyclotron according to claim 1, characterised in that the vertical hill gap profile onto opposite hill sectors is deformed such that one profile shows a profound bump (42*a*) on the last turn (11) of the orbit and the other profile shows a profound dip (42*b*) on the last turn (11) of the orbit.

8. Cyclotron according to claim 1, characterised in that an arrangement of permanent magnets (44*a* and 44*b*) is placed in two opposite valleys such that in one valley a sharp magnetic field bump is created on the last turn (11) of the orbit and in the opposite valley a magnetic field dip is created on the last turn (11) of the orbit.

9. Cyclotron according to claim 1, wherein a gradient corrector (10) is present as the exit of the groove (7).

10. Cyclotron according to claim 9, characterised in that the gradient corrector (10) comprises unshielded permanent magnets (250) and shows a completely open vertical gap and small compensating permanent magnets (300) in order to minimise the perturbing magnetic field at the internal orbit.

11. Cyclotron according to claim 1, characterised in that a lost beam stop (8) is placed behind the exit of the gradient corrector (10) at the azimuth where there is a significant turn separation between the extracted beam (12) and the last turn (11) of the orbit.

12. Cyclotron according to claim 1, characterised in that in the return yoke (2) a pair of horizontally and vertically focusing quadruples (13) is placed after the vacuum exit port (17) which are made of unshielded permanent magnets (400).

13. Use of the cyclotron according to claim 1 for extracting a charged particle beam on the last turn (11) of the orbit by producing a sharp dip (200) in the magnetic field.

* * * * *

UNITED STATES PATENT AND TRADEMARK OFFICE

CERTIFICATE OF CORRECTION

PATENT NO. : 6,683,426 B1
DATED : January 27, 2004
INVENTOR(S) : Kleeven

It is certified that error appears in the above-identified patent and that said Letters Patent is hereby corrected as shown below:

Column 2,
Line 46, “which produces on” should read -- which produces an --

Column 6,
Line 53, “must be small Preferably,” should read -- must be small. Preferably, --

Column 7,
Line 23, “magnetic field snape.” should read -- magnetic field shape. --
Line 45, “Lorencz force,” should read -- Lorentz force, --

Column 8,
Line 4, “make several tuns” should read -- make several turns --

Column 10,
Lines 28-30, “three pairs of sectors (3, 4) called “pairs of hill sectors” and separated from each other by a pair of sectors (3, 4) called “pair of valley sectors”, each” should read -- three pairs of hill sectors (3, 4) separated from each other by a pair of valley sectors (3, 4), each --
Lines 43-47, “hill sectors (3) is present a groove (7), said groove (7) or said plateau (7') following the shape of the extracted orbit and the vertical gap at said groove (7) or at said plateau (7') increasing stepwise” should read -- hill sectors (3) a groove (7) or a plateau (7') is present, said groove (7) or plateau (7') following the shape of the extracted orbit, the vertical gap at said groove (7) or plateau (7') increasing stepwise --
Lines 58-59, “wherein a “plateau” (7')” should read -- wherein a plateau (7') --

Signed and Sealed this

Twenty-second Day of June, 2004

JON W. DUDAS
*Acting Director of the United States Patent and Trademark Office*